US006902353B2

(12) United States Patent
Nelson et al.

(10) Patent No.: US 6,902,353 B2
(45) Date of Patent: Jun. 7, 2005

(54) TOP BLOCK FOR RETAINING WALL

(76) Inventors: Ned H. Nelson, 1021 92nd Ave. NE., Bellevue, WA (US) 98004; William H. Duesenberg, 12356 Northup Way, Suite 109, Bellevue, WA (US) 98005

( * ) Notice: Subject to any disclaimer, the term of this patent is extended or adjusted under 35 U.S.C. 154(b) by 0 days.

(21) Appl. No.: 10/126,797

(22) Filed: Apr. 19, 2002

(65) Prior Publication Data

US 2002/0176751 A1 Nov. 28, 2002

Related U.S. Application Data

(60) Provisional application No. 60/285,206, filed on Apr. 19, 2001.

(51) Int. Cl.[7] ..... E02D 5/20
(52) U.S. Cl. ..... 405/287
(58) Field of Search ..... 405/284, 286, 405/287, 287.1; 52/604, 610, 611

(56) References Cited

U.S. PATENT DOCUMENTS 3,597,925 A * 8/1971 Kusatake ..... 52/610
4,619,560 A * 10/1986 Crinnion et al. ..... 52/604

FOREIGN PATENT DOCUMENTS

GB 160928 * 3/1921 ..... 52/611
GB 2170258 * 7/1986 ..... 52/611

* cited by examiner

*Primary Examiner*—Michael Safavi
(74) *Attorney, Agent, or Firm*—Garrison & Associates PS; David L. Garrison

(57) ABSTRACT

A top block for modular precast retaining wall system wherein beveled surfaces of a horizontal component of the top block form a cast-in-place key integrated with cast-in-place column formed in the construction of the retaining wall using modular block units. The top block provides an aesthetically pleasing front surface the upper edge of which may be rectilinear or contoured to fit various applications and appearance requirements.

7 Claims, 4 Drawing Sheets

FIG. 4
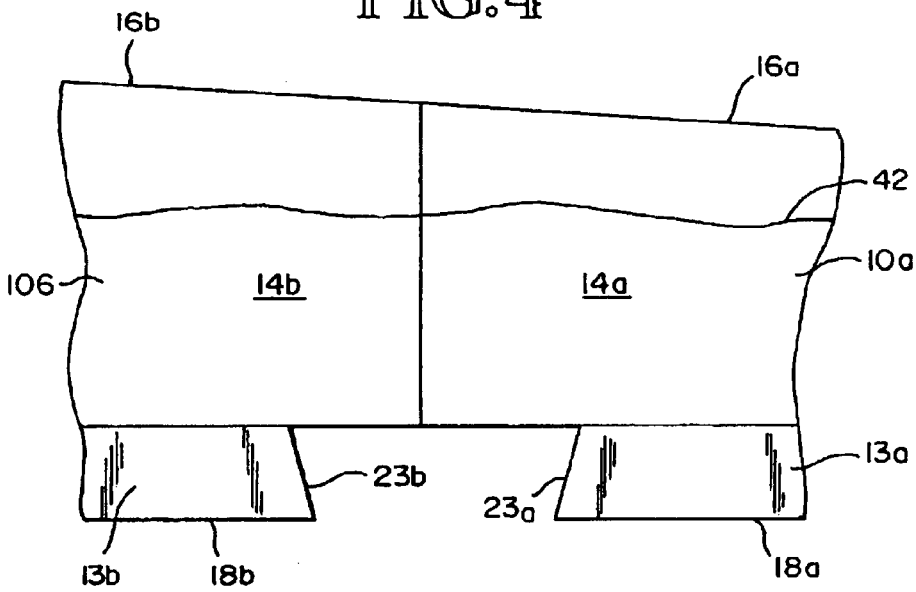
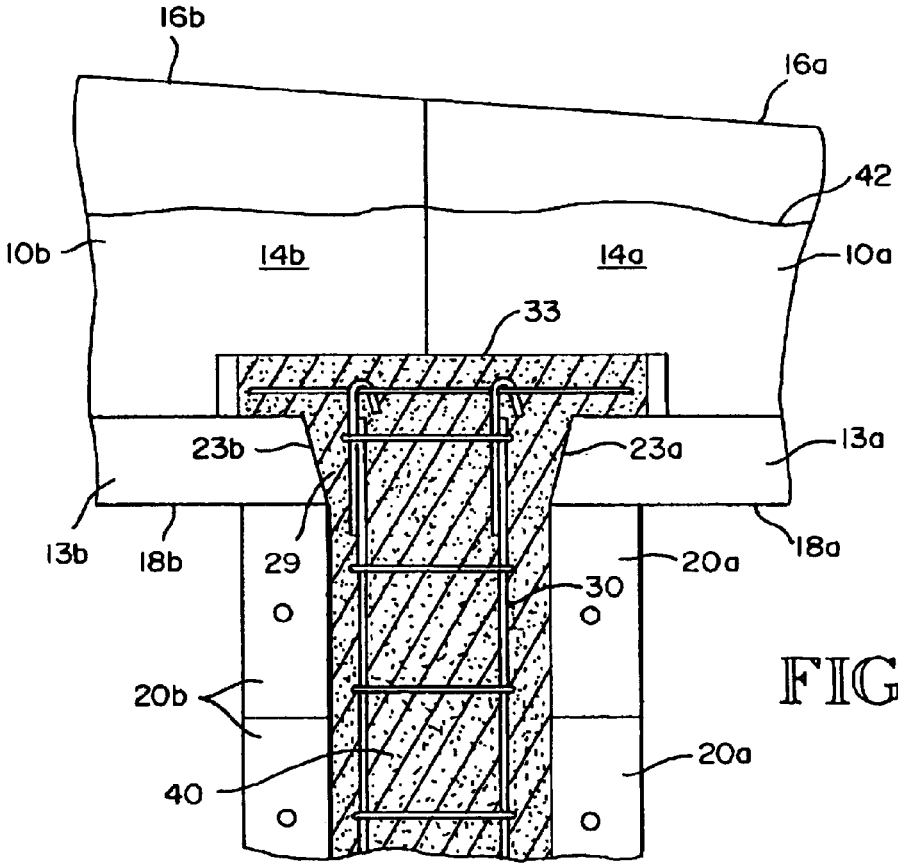
FIG. 5

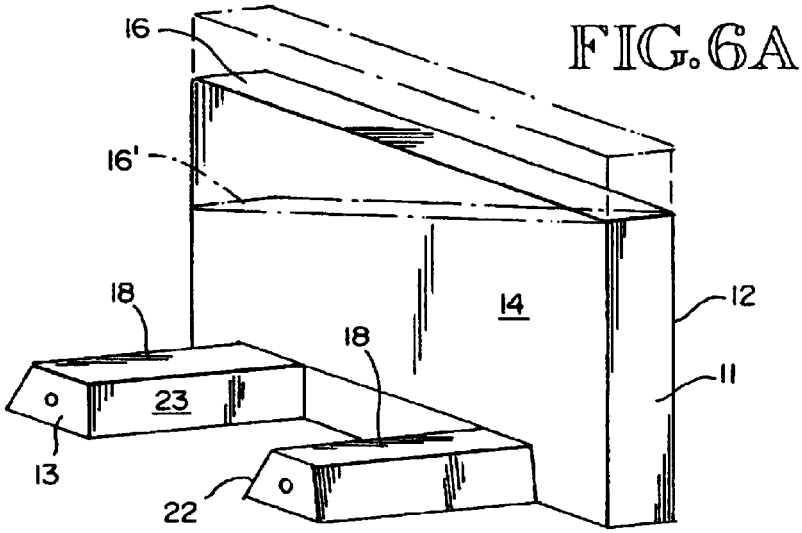
FIG. 6A
FIG. 6B
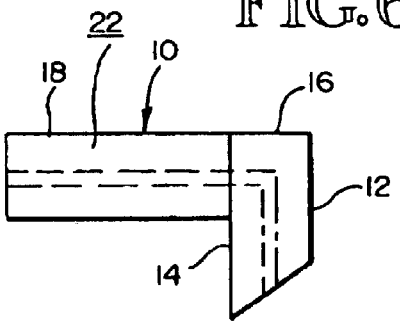
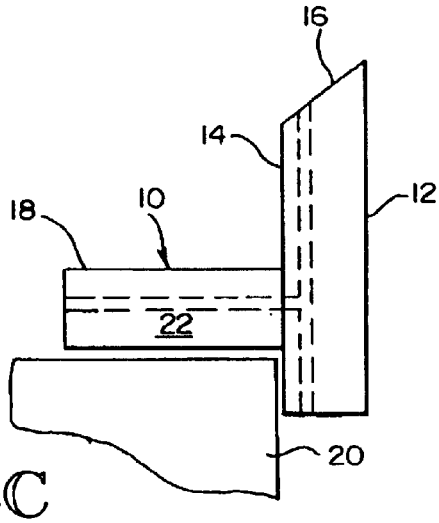
FIG. 6C

FIG. 7
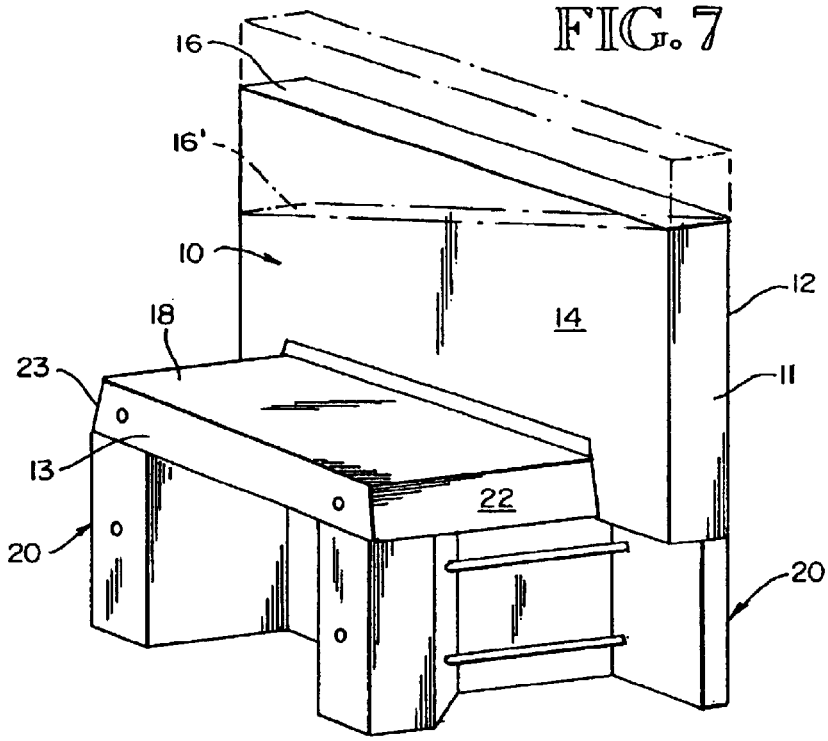
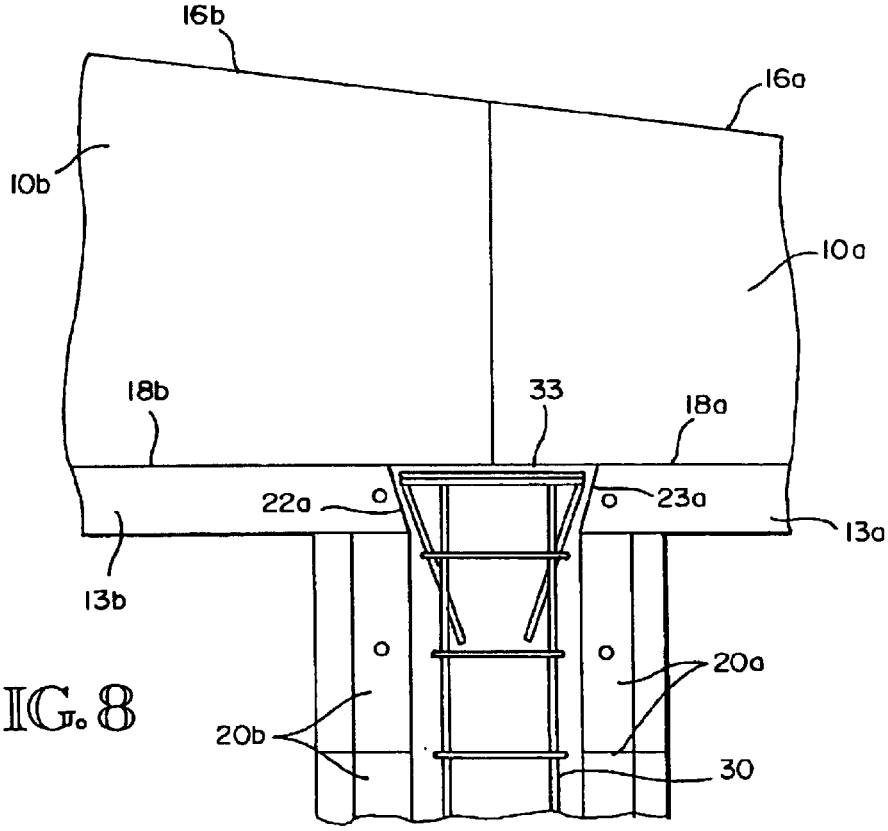
FIG. 8

TOP BLOCK FOR RETAINING WALL

CROSS-REFERENCE TO RELATED APPLICATION

This application claims the benefit of U.S. Provisional Application Ser. No. 60/285,206, entitled Top Block for Retaining Wall, filed Apr. 19, 2001.

BACKGROUND OF THE INVENTION

This invention relates to a pre-cast, reinforced, modular retaining wall system, and more particularly to the top module for such pre-cast, reinforced, modular retaining wall systems. This invention finds particular application with pre-cast, reinforced concrete retaining wall systems, such as is disclosed in U.S. Pat. No. 4,957,395, issued Sep. 18, 1990 to Ned Nelson, which patent is incorporated in its entirety in this application by reference as if fully set forth. The Nelson device provides for a reinforced concrete modular retaining wall system, but like other modular retaining wall systems lacks a top block to complete the installation. The Nelson patent makes no provision for a final top block and makes no suggestion as to how one might attach a top block to obtain a structurally integrated retaining wall using the modules taught therein.

SUMMARY OF THE INVENTION

A top block having an aesthetically pleasing front surface and provision for interlocking into a retaining wall having a cast-in-place column structure, so that the top block becomes an integral part of the structure is disclosed herein. The top block includes a front element and a lower element. The front element has a vertical front surface having a width substantially equal to the width of the modular blocks to which it is attached and a thickness of up to about 8 inches. The top block has a horizontal, angled or contoured top surface as desired. The angled or contoured top surface is utilized whenever the retaining wall is assembled on a longitudinally sloping surface or situations in which a particular aesthetic effect using a non-rectilinear front configuration is desired. The lower element of the top block is attached to the top block front surface and formed as an integral part thereof; including a support member extending rearwardly and sized to fit on top of the module to which it is to be attached. Sloped ends on the lower element with provision for rebar reinforcements are provided so that attachment to the cast-in-place column is easy and secure. In cross-section, the top block is preferably L-shaped and cast in a unitary structure with reinforcing rods or other reinforcing means incorporated therein. The front element may be in the form of or associated with a traffic barrier. The top blocks are assembled side-by-side on top of the subjacent modules, and arranged so that the reinforced concrete column to be poured, extends upwardly and ties together with the top module to form an integrated structure on top of the structure shown in the Nelson Patent. The topmost portion of the column acts as cast-in-place keystone securely fastening the top block in place. Preferably, for additional attachment strength, the poured column extends upwardly to overlap the pre-cast top modular block and tie it to the reinforcing bar cage below. The poured column may incorporate attachments to soil anchors or other stabilizing means, at the level of the retaining wall blocks or at the level of the top block.

BRIEF DESCRIPTION OF DRAWINGS

These and other features, aspects, and advantages of the present invention will become better understood with regard to the following description, appended claims, and accompanying drawings where:

FIG. 4 is a rear elevational view of two pre-cast top blocks placed approximately side-to-side;

FIG. 5 is a rear elevational view of two pre-cast top blocks placed approximately side-to-side, with a cast-in-place column, and subjacent modules of the retaining wall;

FIG. 6*a* is a side view of an alternative embodiment of the pre-cast top block;

FIGS. 6*b–c* are end elevation views of alternative embodiments of the pre-cast top block;

FIG. 7 is a perspective view of a portion of a modular concrete retaining wall system having one of the top blocks of this invention positioned thereupon; and FIG. 8 is a partial rear elevational view of a modular retaining wall incorporating this invention prior to placing the concrete to form the cast-in-place column.

BEST MODE FOR CARRYING OUT THE INVENTION

Figure 1:
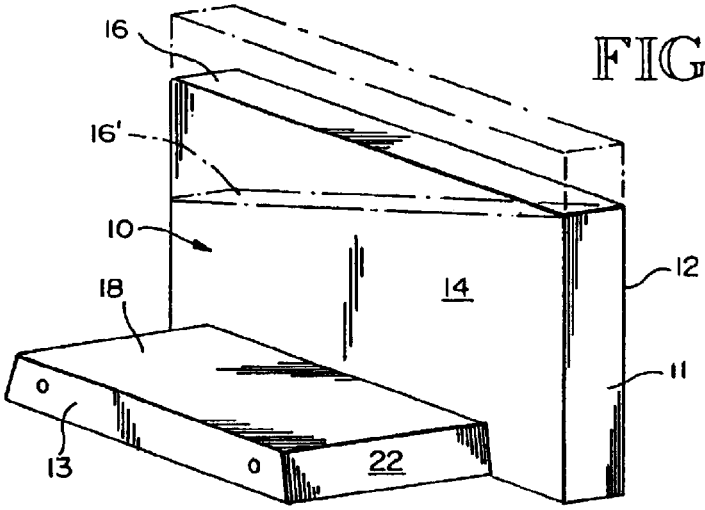
FIG. 1 shows a perspective view of a pre-cast top block.
Figure 2:
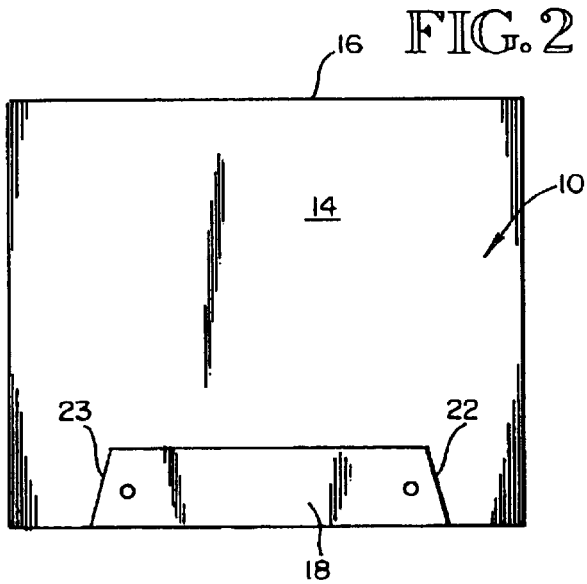
FIG. 2 is a rear elevational view of a pre-cast top block.
Figure 3:
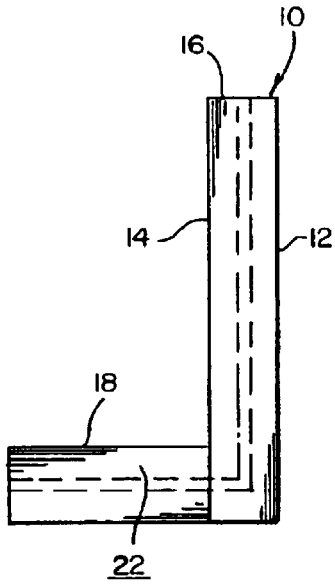
FIG. 3 is side view of a pre-cast top block.

Referring to the drawings, wherein like numerals indicate like parts, FIGS. 1, 2 and 3 show rear perspective and side views of the configuration of the top block 10 of this invention. The top block 10 is configured and sized to mate with and engage a standard modular block used in the construction of retaining walls such as the modular block shown in Nelson U.S. Pat. No. 4,957,395. The top block 10 is shown as a pre-cast L-shaped concrete structure having a front element 11 and lower element 13. The front element 11 includes a front surface 12 and back surface 14. Lower element 13 has rearward extending portion 18 having surfaces 22 and 23, which when placed in cooperation with a second top block 10, define a space or keyway to connect and interlock the structure to the cast-in-place column 40. In the preferred embodiment, the keyway is defined in the form of beveled surfaces 22 and 23 along the edges of the rearwardly extending portion 18 of the lower element 13. Various alternative key means may be utilized to form a secure joint with the cast-in-place column as will be apparent to one of ordinary skill in the pre-cast concrete art.

FIG. 4 illustrates two top blocks 10*a–b* positioned approximately end to end with the keyway defined between surfaces 22*b* and 23*a*.

FIG. 5 illustrates two top blocks 10*a–b* positioned approximately end to end with the keyway defined between surfaces 22*b* and 23*a*, the cast-in-place column 40, and its rebar 30 and 33. The two top blocks 10*a–b* are positioned upon a plurality of retaining wall block modules 20*a–b* ready for placement of concrete to form the cast-in-place column 40 of the retaining wall. The cast-in-place column 40 is formed between the 20*a–b*, and in this embodiment the cap of the cast-in-place column 37 is enlarged and extends above the top surface of the rearwardly extending rear element 18.

FIGS. 6*a–c* illustrate alternative embodiments of the top block 10. FIG. 6*a* illustrates an alternative embodiment with the surfaces defining a space or keyway are entirely within one top block 10 rather than being formed in cooperation with two top blocks as depicted in FIG. 4. FIG. 6*b* illustrates an alternative embodiment where the front element 12 extends below the lower element 13 to trim the subjacent portion of the retaining wall. FIG. 6*c* illustrates an alternative embodiment where the front element 12 extends both above and below the lower element 13, and is trimmed as appropriate for the application.

FIG. 7 illustrates the top block 10 positioned on a stack of wall block modules 20 without any adjacent stacks being depicted, and prior to pouring the cast-in-place column. The front element 11 may be positioned with its front face substantially paralleled to the front face of a sub-adjacent module or may be set back, angled or otherwise altered for modified aesthetics.

In FIG. 8, an alternate means of connecting the top blocks 10*a–b* to the stack of wall block modules 20*a–b* is illustrated where the cast-in-place column 40 after pouring will terminate approximately at the level of the upper surface of the rearwardly extending portion 18 of lower element 13 of the top block module. In addition, FIG. 8 shows an angled upper surface 16*a–b* for the block having an angle which may be established to conform to the contour of adjacent land structure or be modified in obvious ways for aesthetic purposes.

Top block 10 is manufactured in a pre-casting operation in which a mold is configured with the interior surfaces thereof corresponding to the surfaces for the top block module as shown in the various figures. Reinforcing bar is placed into the mold at appropriate locations which will be readily apparent to one of ordinary skill in the art, and concrete is then placed into the mold or form and consolidated such as by vibration to form the top block, Concrete pre-casting techniques well known in the art are utilized in the preparation of the top block as well as the retaining wall block modules as described in the aforementioned Nelson Patent. To assemble the retaining wall with its top block, the techniques described in the aforementioned Nelson Patent are utilized to construct the retaining wall, including preparation for the cast-in-place concrete column 40 shown in FIGS. 5 and 8. The appropriate reinforcing member such as reinforcing bar cage 30 is utilized in preparation for placing the concrete in the formation of column 40. As a final step prior to placing the concrete, top block modules 10 are placed on top of retaining wall block modules 20 with the beveled or chamfered surfaces 22 and 23 exposed for contact and engagement with the concrete to be poured in the formation of column 40. In instances in which the top of column 40 is desired to be level with the upper surface of the rearward extending portion 18 of lower element 13, the configuration showed in FIG. 8 is used with key rebar 33 shown positioned slightly below the level of the upper surface of rearwardly extending portion 18 of lower element 13. Concrete is then poured into the cavity to form column 40 with the upper surface thereof screed or finished even with the upper surface of rearward extending portion 18. In the event an additional strengthening member is desired on top of the cast-in-place key area 29, the configuration shown in FIG. 5 may be utilized in which raised cast-in-place cap 37 is formed by extending the reinforcing bar 30 upwardly and placing a top key rebar 33 as shown in FIG. 5. The concrete is then poured into the column and a small additional form element utilized to contain the top key cap area 34 in the configuration showed in FIG. 5.

For either configuration of the top key zone of column 40, the ground or fill 52 adjacent the retaining wall may be raised any desired level such as shown in FIGS. 4 and 5. Fill or pavement as desired may be raised to any level such as grade 42. If pavement is used, the front element 11 of top block 10 may serve as a traffic barrier or in the alternative a barrier such as that known as a "jersey barrier" may be utilized positioned adjacent the front element 11 of top block 10.

In some application an anchor connected by an anchor member may be utilized in conjunction with the device of this invention to securely anchor the top block key area of the column 40 to adjacent soil or other structure. In addition, a comparable anchor may be connected by anchor member to column 40 at the location of one or more of the block 20.

In compliance with the statute, the invention has been described in language more or less specific as to structural features of the various embodiments taught herein. It is to be understood however, that the invention is not limited to the specific features shown since the means and construction herein disclosed comprise a preferred form of putting the invention into effect. The invention is, therefore, claimed in any of its forms or modifications within the legitimate and valid scope of the appended claims appropriately reinterpreted in accordance with the doctrine of equivalents.

Industrial Applicability

This invention finds applicability in the construction of retaining wall structures wherein pleasing aesthetic top finish for the wall is desired or in which additional strength due to the key structure of the cast-in-place column is required to enhance the strength of the wall. The retaining wall may be utilized to hold back earth in many applications including highways, parking areas and generally in areas in which the adjacent earth is unstable.

We claim:

1. A retaining wall modular system formed from a plurality of pre-cast concrete wall modules and top blocks, said retaining wall comprising:

one or more courses of said pre-cast concrete wall modules set end to end and configured to form a void therebetween;

a cast-in-place column formed in said void and extending vertically;

said top blocks placed on top of said pre-cast wall modules and positioned end to end, said top blocks each comprising a front vertically oriented element extending upwardly from a lower surface adapted to engage and be supported by a sub-adjacent wall module, a rearwardly extending element cast simultaneously with said front element and extending along said lower surface, said rearwardly extending element having means thereon to attach each top block to said cast-in-place column formed as a part of the retaining wall modular system.

2. The apparatus of claim 1 wherein said means to attach each top block includes beveled surfaces positioned to cooperate with beveled surfaces on an adjacent top block, whereby an upwardly diverging zone is established at the top of said cast-in-place column to form a key, whereby said top blocks are locked to said cast-in-place column.

3. The apparatus of claim 1 wherein said means to attach each top block includes beveled surfaces positioned to cooperate with beveled surfaces on an adjacent top block whereby an upwardly diverging zone is established at the top of said cast-in-place column to form a key.

4. The apparatus of claim 1 having a reinforcing bar positioned within said cast-in-place column.

5. The apparatus of claim 1 wherein said front vertically oriented element extends upwardly in plane substantially coplanar with the front surface of said sub-adjacent module.

6. A retaining wall modular system formed from a plurality of pre-cast concrete wall block modules and top blocks, said retaining wall comprising:

one or more courses of said pre-cast concrete wall block modules set end to end and configured to form a void therebetween;

a concrete cast-in-place column formed in said void; and said top blocks placed on top of said plurality of pre-cast concrete wall block modules and positioned end to end, said top blocks each comprising a front vertically oriented element extending upwardly from a lower surface adapted to engage and be supported by a sub-adjacent pre-cast concrete wall block module, a rearwardly extending element cast simultaneously with said front element and extending along said lower surface, said rearwardly extending element having means thereon to attach each top block to said cast-in-place column formed as a part of said retaining wall modular system.

7. The apparatus of claim 6 wherein said means to attach each top block includes beveled surfaces positioned to cooperate with beveled surfaces on an adjacent top block, whereby an upwardly diverging zone is established at the top of said cast-in-place column to form a key.

* * * * *